US006827549B1

(12) United States Patent
Horng et al.

(10) Patent No.: US 6,827,549 B1
(45) Date of Patent: Dec. 7, 2004

(54) HEAT-DISSIPATING MODULE

(75) Inventors: Alex Horng, Kaohsiung (TW); Yin-Rong Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 10/465,590

(22) Filed: Jun. 20, 2003

(30) Foreign Application Priority Data

May 16, 2003 (TW) ..... 92113404 A

(51) Int. Cl.[7] ..... F04D 19/02

(52) U.S. Cl. ..... 415/68; 415/61; 415/193; 415/209.1; 415/213.1; 415/214.1

(58) Field of Search ..... 415/60–61, 66–69, 415/199.4, 199.5, 193, 209.1, 213.1, 214.1; 361/692–693, 695–697

(56) References Cited

U.S. PATENT DOCUMENTS 3,083,893 A 4/1963 Dean
4,164,852 A 8/1979 Anzalone
5,258,676 A 11/1993 Reinhardt et al.
5,572,403 A * 11/1996 Mills ..... 361/695
6,244,818 B1 6/2001 Chang
6,343,014 B1 * 1/2002 Lin ..... 361/697
6,537,019 B1 * 3/2003 Dent ..... 415/61
6,612,817 B2 9/2003 Lin et al.
6,626,653 B2 9/2003 Lin et al.
6,663,342 B2 * 12/2003 Huang et al. ..... 415/199.5

* cited by examiner

*Primary Examiner*—Christopher Verdier
(74) *Attorney, Agent, or Firm*—Bacon & Thomas, PLLC

(57) ABSTRACT

A heat-dissipating module including a first fan unit, a second fan unit, and a connecting arrangement for connecting the first fan unit and the second fan unit in a serial manner. The first fan unit is located on an air inlet side and includes a casing and a fan wheel received in the casing of the first fan unit. The second fan unit is located on an air outlet side and includes a casing and a fan wheel received in the casing of the second fan unit. At least one side air inlet is defined between the casing of the first fan unit and the casing of the second fan unit for increasing an air inlet amount and an air outlet amount of the second fan unit.

7 Claims, 7 Drawing Sheets

HEAT-DISSIPATING MODULE

BACKGROUND OF THE INVENTION

1. Field of the Invention

The present invention relates to a heat-dissipating module. In particular, the present invention relates to a heat-dissipating module including a plurality of serially connected heat-dissipating fans.

2. Description of Related Art

FIG. 1 is an exploded perspective view of a conventional heat-dissipating module. FIG. 2 is a perspective view of the conventional heat-dissipating module. The heat-dissipating module includes a first fan unit 10, a second fan unit 20 that is serially connected to the first fan unit 10, and a stationary blade 30. The first fan unit 10 is located on the air inlet side, and the second fan unit 20 is located on the air outlet side. The stationary blade 30 is provided on a base portion of a casing 100 of the first fan unit 10 for guiding air current and for increasing the wind pressure. Generally, the casing 100 of the first fan unit 10 includes a plurality of engaging notches or grooves 111 and the casing 200 of the second fan unit 20 includes a plurality of engaging tabs 21 for engaging with the engaging grooves 11, thereby serially connecting the first fan unit 10 and the second fan unit 20 together. Thus, air is driven by a fan wheel (not shown) of the first fan unit 10 and a fan wheel 22 of the second fan unit 20, thereby rapidly blowing the air from the air inlet side to the air outlet side.

Although the amount of blown air and the velocity of the air are increased through the use of the above-mentioned heat-dissipating module, several problems still exist. Firstly, cool air can only be sucked into the heat-dissipating module via a single air inlet of the first fan unit 10 on the air inlet side under normal operation of the first fan unit 10 and the second fan unit 20. The overall air output amount is limited. Second, when the first fan unit 10 operates abnormally, the speed of the first fan wheel is lowered and thus adversely affects the air-blowing efficiency of the second fan wheel 22 and the overall heat-dissipating efficiency. Third, when the first fan unit 10 operates abnormally, the air density distribution is not uniform since the air velocity at the first fan wheel is different from that at the second fan wheel 22, resulting in poor static pressure-flow rate characteristics and poor P-Q characteristics and generating wind noise.

OBJECTS OF THE INVENTION

An object of the present invention is to provide a heat-dissipating module including two serially connected fan units and at least one side air inlet for introducing more air into the heat-dissipating module. The overall air inlet amount and the overall air outlet amount are increased, and the overall heat-dissipating efficiency is improved.

Another object of the present invention is to provide a heat-dissipating module include two serially connected fan units and at least one side air inlet for introducing more air into the heat-dissipating module when the first fan unit operates abnormally and thus fails to provide a sufficient air inlet amount. Non-uniform air density distribution in the heat-dissipating module is avoided, and the noise generated during operation of the heat-dissipating module is reduced. The overall heat-dissipating efficiency is thus improved.

SUMMARY OF THE INVENTION

To achieve the aforementioned objects, the present invention provides a heat-dissipating module including a first fan unit, a second fan unit, and connecting means for connecting the first fan unit and the second fan unit in a serial manner. The first fan unit is located on an air inlet side and includes a casing and a fan wheel received in the casing of the first fan unit. The second fan unit is located on an air outlet side and includes a casing and a fan wheel received in the casing of the second fan unit. At least one side air inlet is defined between the casing of the first fan unit and the casing of the second fan unit for increasing an air inlet amount and an air outlet amount of the second fan unit.

The air inlet amount and the air outlet amount of the second fan unit are increased. Thus, when the fan wheel of the first fan unit operates abnormally and thus results in a low air-blowing efficiency, the fan wheel of the second fan unit compensates the shortage of air inlet amount resulting in abnormal operation of the fan wheel of the first fan unit by introducing air into the heat-dissipating module via the side air inlet. The air density distribution is uniform, and the noise during operation is reduced.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
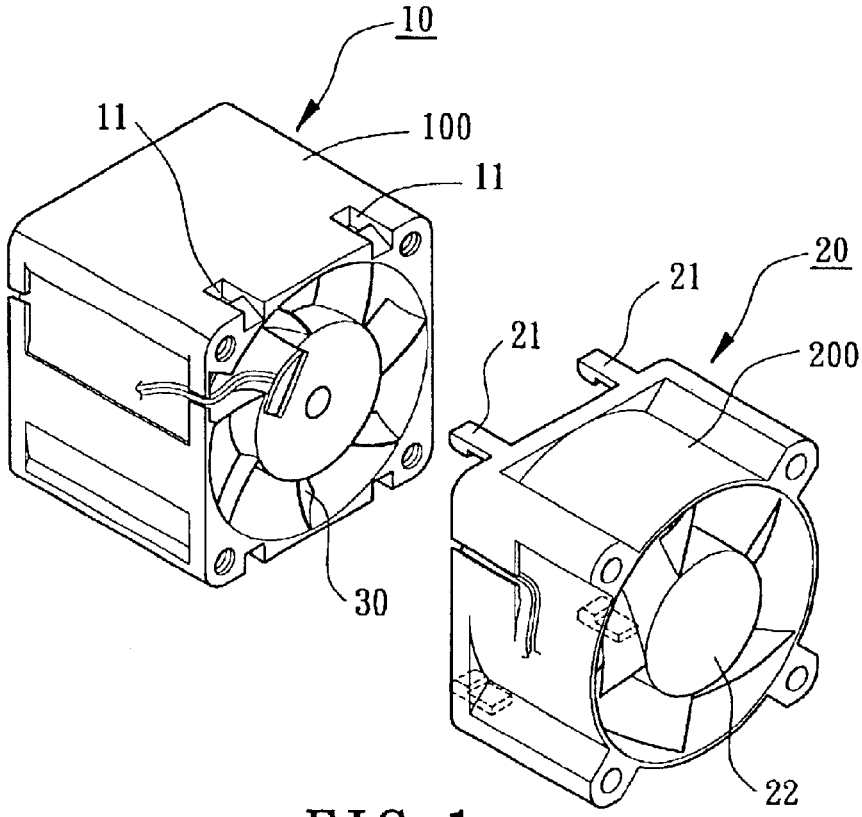
FIG. 1 PRIOR ART
FIG. 1 is an exploded perspective view of a conventional heat-dissipating module.
Figure 2:
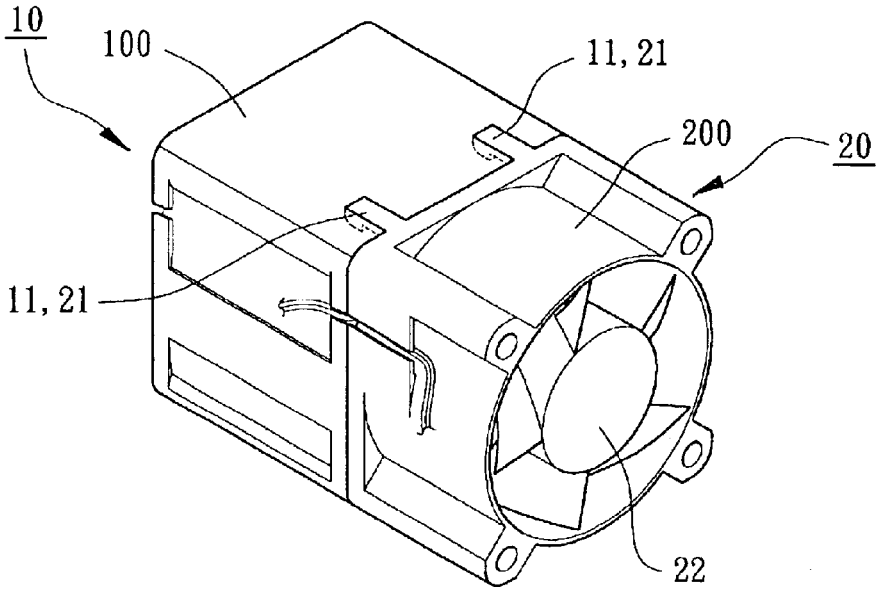
FIG. 2 PRIOR ART
FIG. 2 is a perspective view of the conventional heat-dissipating module.

Preferred embodiments of the present invention are now to be described hereinafter in detail, in which the same reference numerals are used in the preferred embodiments for the same parts as those in the prior art to avoid redundant description.

Figure 3:
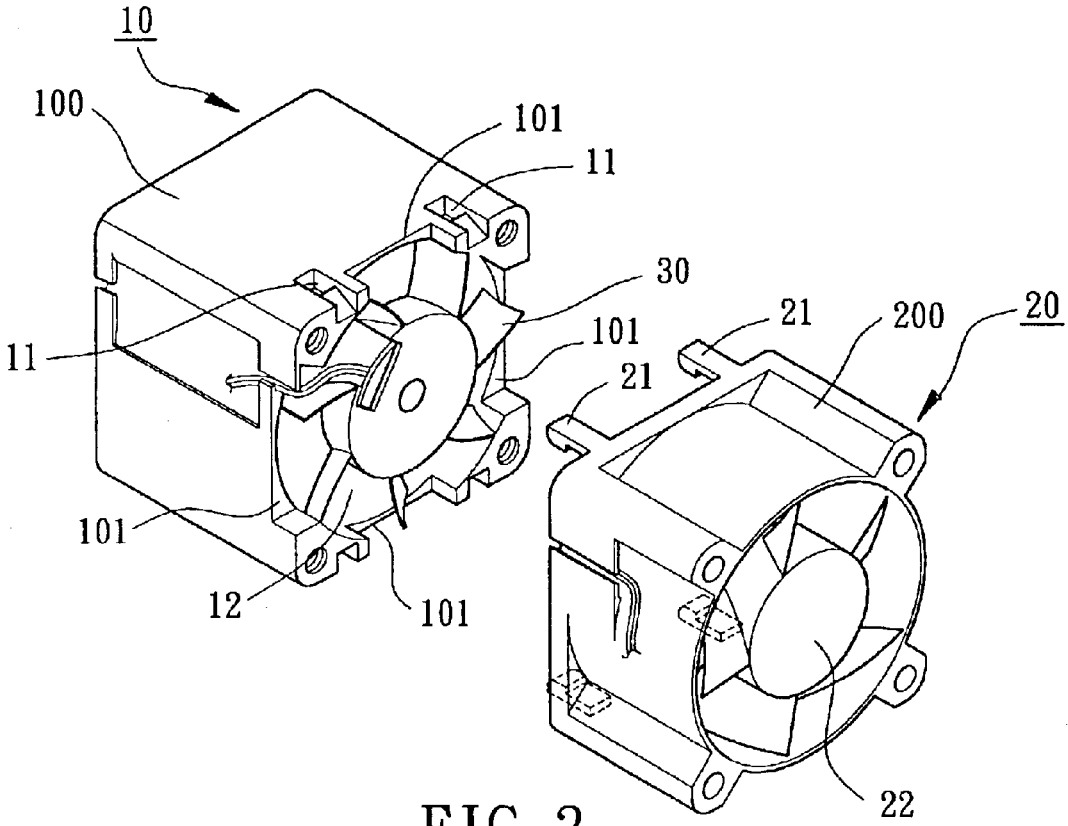
FIG. 3 is an exploded perspective view of a first embodiment of a heat-dissipating module in accordance with the present invention.
Figure 4:
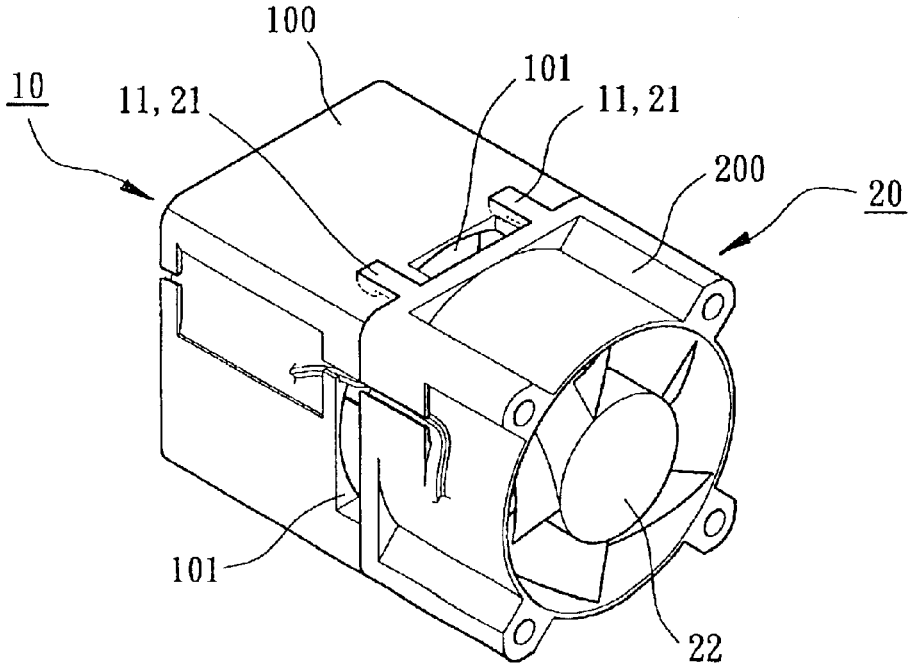
FIG. 4 is a perspective view of the heat-dissipating module in FIG. 3.

Referring to FIGS. 3 and 4, a first embodiment of a heat-dissipating module in accordance with the present invention includes a first fan unit 10, a second fan unit 20, connecting means for connecting first fan unit 10 and the second fan unit 20, and at least one side air inlet 101. The first fan unit 10 is located on the air inlet side and includes a casing 100 in which a fan wheel (not shown) is received. The second fan unit 20 is located on the air outlet side and includes a casing 200 in which a fan wheel 22 is received.

In this embodiment, the connecting means includes a plurality of engaging grooves 11 defined in the casing 100 of the first fan unit 10 and a plurality of engaging tabs 21 extending from the casing 200 of the second fan unit 20 for engaging with the engaging groove of the casing 100 of the first fan unit 10, thereby serially connecting the first fan unit 10 and the second fan unit 20.

At least one side air inlet 101 is defined between the first fan unit 10 and the second fan unit 20 after serial connection of the first fan unit 10 and the second fan unit 20. In this embodiment, there are four side air inlets 101 respectively in the four sides of the heat-dissipating module, and each side air inlet 101 is a recess formed in one of two mutually facing end faces respectively of the casing 100 of the first fan unit 10 and the casing 200 of the second fan unit 20. An air passage 12 in the heat-dissipating module is communicated with the outside via the side air inlets 101. Thus, the amount of inlet air and the amount of the outlet air can be increased through provision of the side air inlets 101. More specifically, when the first fan unit 10 operates abnormally and thus causes low air-blowing efficiency (i.e., the amount of air sucked by the first fan unit 10 into the heat-dissipating module is decreased), the fan wheel 22 of the second fan unit 20 compensates the shortage of air supposed to be provided by the first fan unit 10 through the side inlets 101. Also, the air sucked into the heat-dissipating module through the side inlets 101 compensates the temporarily existing zone with non-uniform air density distribution resulting from the difference between the amount of air driven by the first fan unit 10 and the amount of air blown by the second fan unit 20.

The heat-dissipating module in accordance with the present invention may include at least one stationary blade 30 for guiding air current and for increasing the wind pressure. The stationary blade 30 may be provided on the air inlet side or the air outlet side of the casing 100 of the first fan unit 10. Alternatively, the stationary blade 30 is provided on the air inlet side or the air outlet side of the casing 200 of the second fan unit 20.

Figure 5:
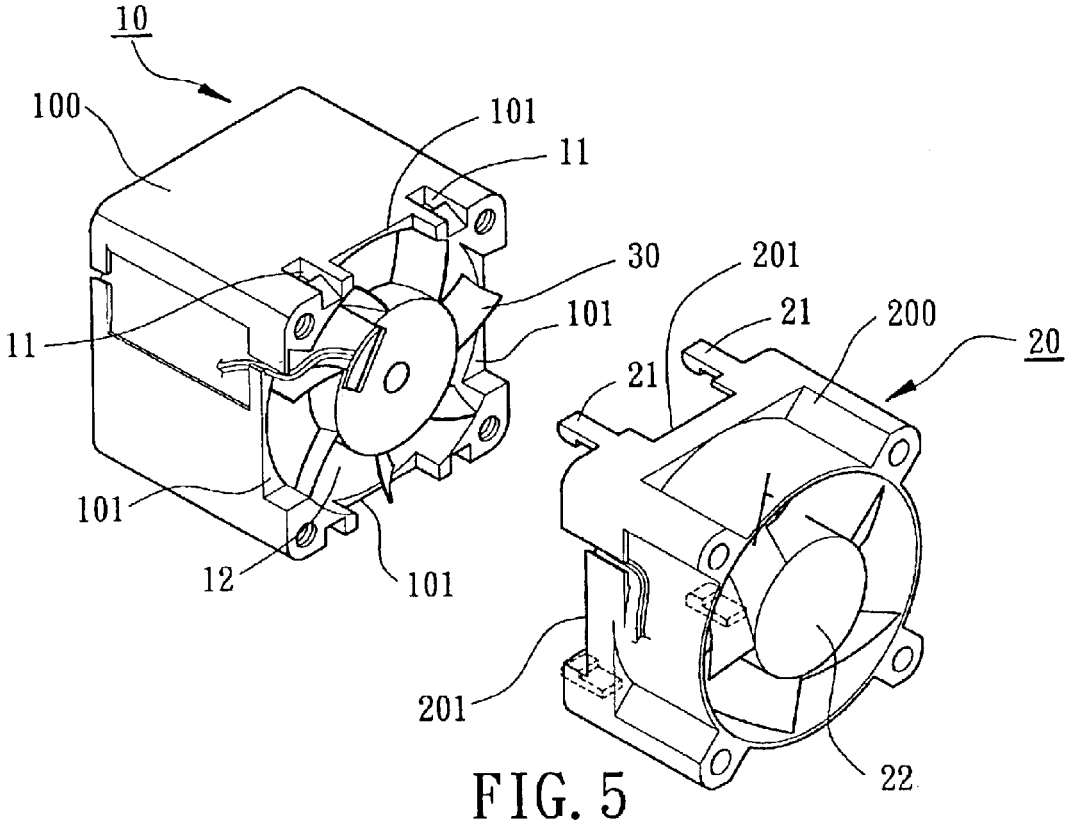
FIG. 5 is an exploded perspective view of a second embodiment of the heat-dissipating module in accordance with the present invention.
Figure 6:
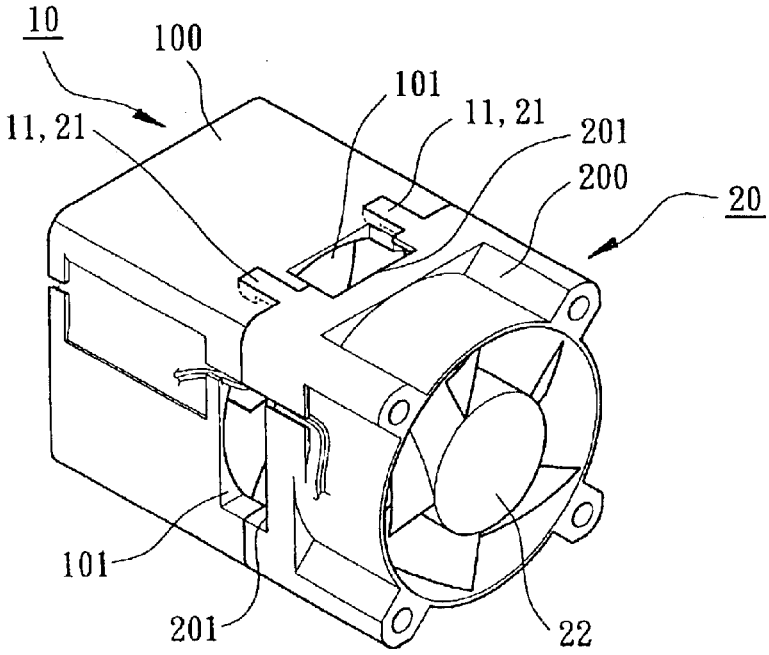
FIG. 6 is a perspective view of the heat-dissipating module in FIG. 5.

FIGS. 5 and 6 illustrate a second embodiment of the heat-dissipating module in accordance with the present invention, wherein the second fan unit 20 includes four recesses 201 in the end face of the casing 200 of the second fan unit 20 that face and communicate with the recess of the casing 100 of the first fan unit 10. This increases the area for introducing ambient air into the heat-dissipating module. Namely, the side air inlets 101 and 201 are larger. The amount of air introduced into the heat-dissipating module is increased accordingly.

Figure 7:
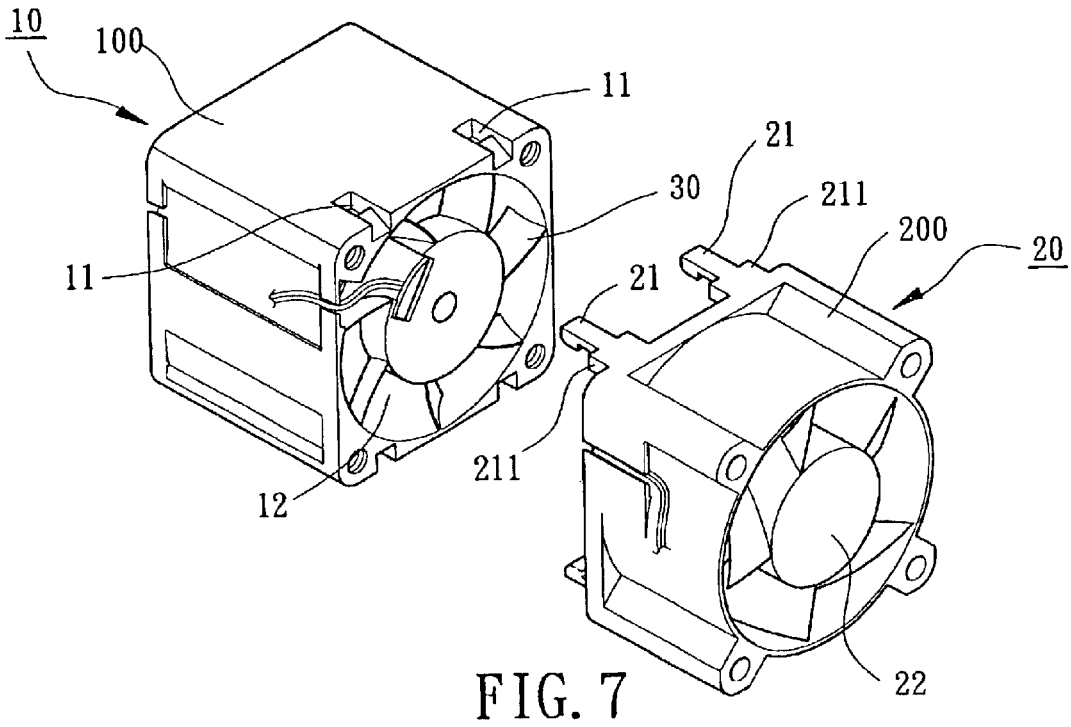
FIG. 7 is an exploded perspective view of a third embodiment of the heat-dissipating module in accordance with the present invention.
Figure 8:
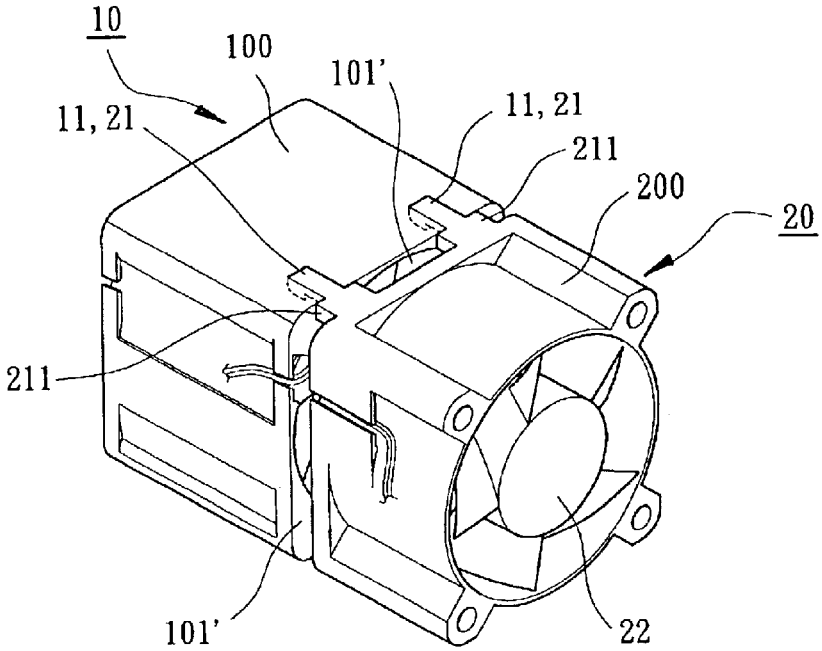
FIG. 8 is a perspective view of the heat-dissipating module in FIG. 7.

FIGS. 7 and 8 illustrate a third embodiment of the heat-dissipating module in accordance with the present invention, wherein each engaging tab 21 of the second fan unit 20 includes a spacing portion 211 (in the form of a thickened portion in this embodiment). Thus, when the first fan unit 10 and the second fan unit 20 are serially connected, the spacing portions 211 of the engaging tabs 21 allow the second fan unit 20 to be spaced apart from the first fan unit 10, thereby forming four side air inlets 101'. The side air inlets 101' increase the air input amount and the air output amount of the second fan unit 20 without modifying the basic designs of the casings 100 and 200 of the first and second fan units 10 and 20.

Figure 9:
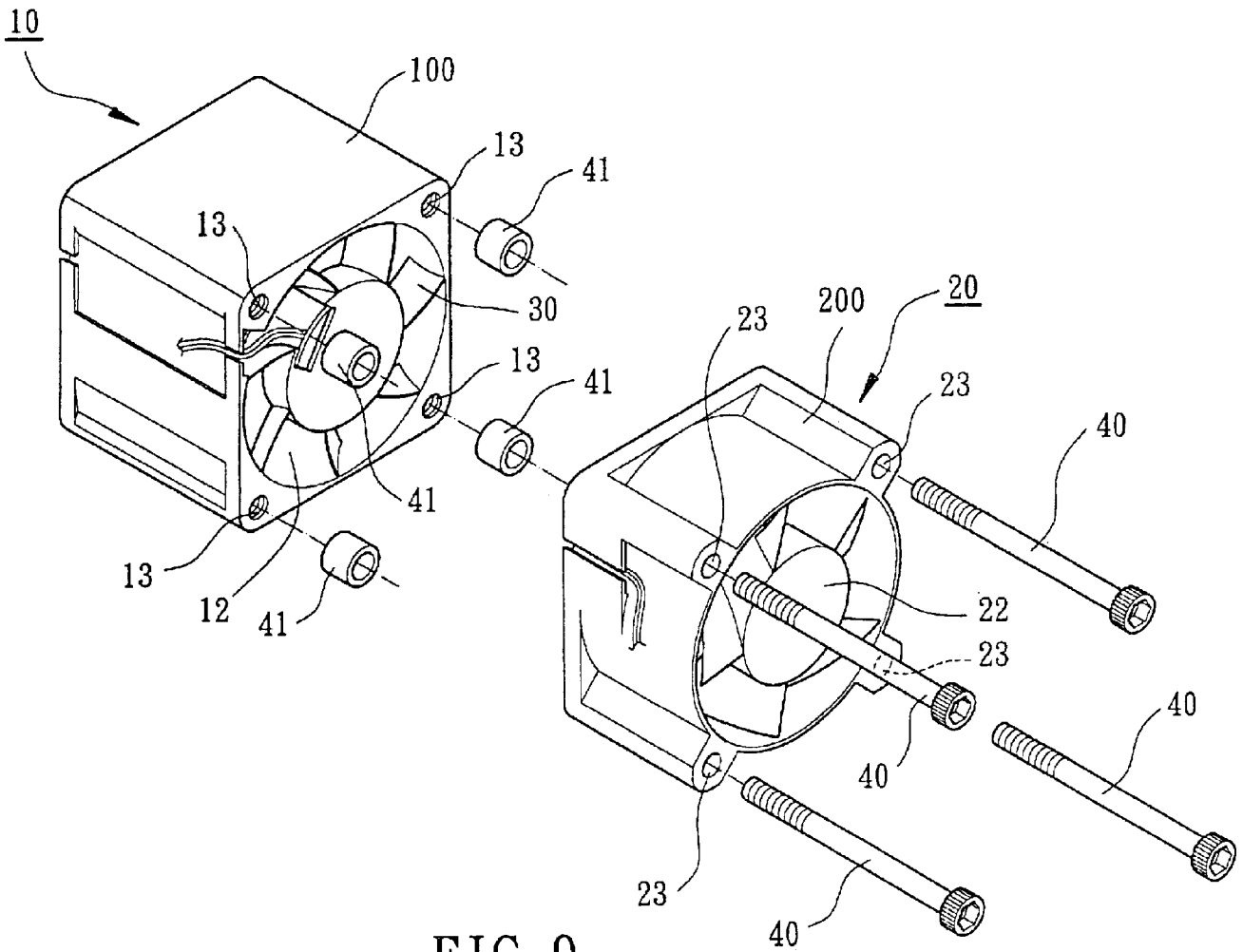
FIG. 9 is an exploded perspective view of a fourth embodiment of the heat-dissipating module in accordance with the present invention.
Figure 10:
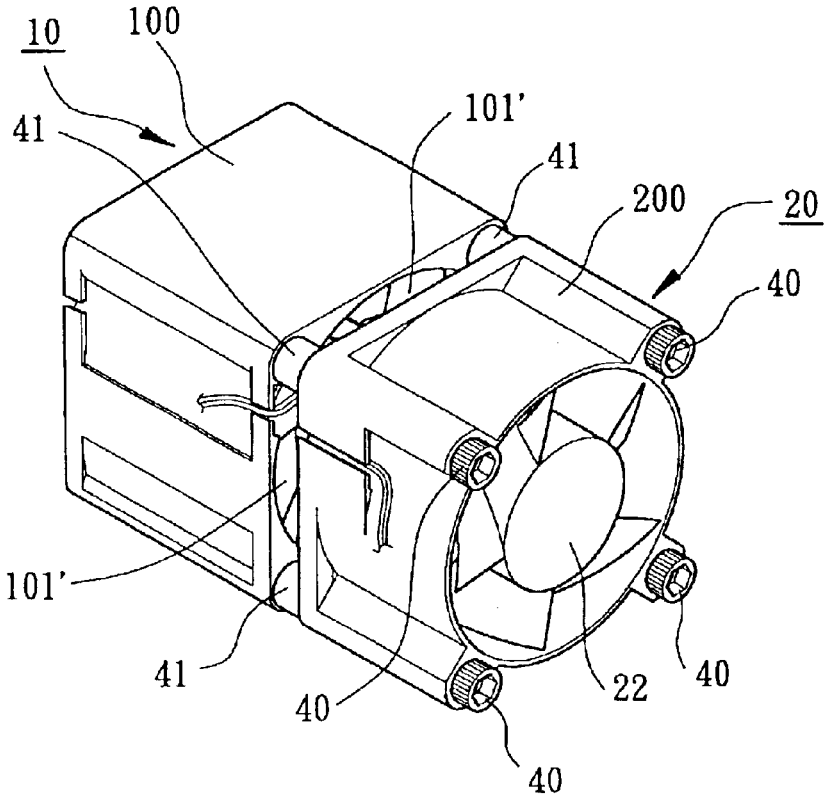
FIG. 10 is a perspective view of the beat-dissipating module in FIG. 9.

FIGS. 9 and 10 illustrate a fourth embodiment of the invention, wherein the connecting means in this embodiment includes a plurality of spacers 41 and a plurality of fasteners 40 such as bolts. Each fastener 40 is extended through a respectively through-hole 23 in the second fan unit 20 and a respective spacer 41 into a respective screw hole 13 of the first fan unit 10, thereby serially connecting the first fan unit 10 and the second fan unit 20 together. Further, the spacers 41 allow the first fan unit 10 and the second fan unit 20 to be spaced apart from each other, thereby forming at least one side air inlet 101' between the mutually facing end faces respectively of the first fan unit 10 and the second fan unit 20. The side air inlets 101' increase the air input amount and the air output amount of the second fan unit 20 without modifying the basic designs of the casings 100 and 200 of the first and second fan units 10 and 20.

The first fan unit 10, the spacers 41, and the second fan unit 20 can be integrally formed with one another by injection molding without the need of the fasteners 40.

Figure 11:
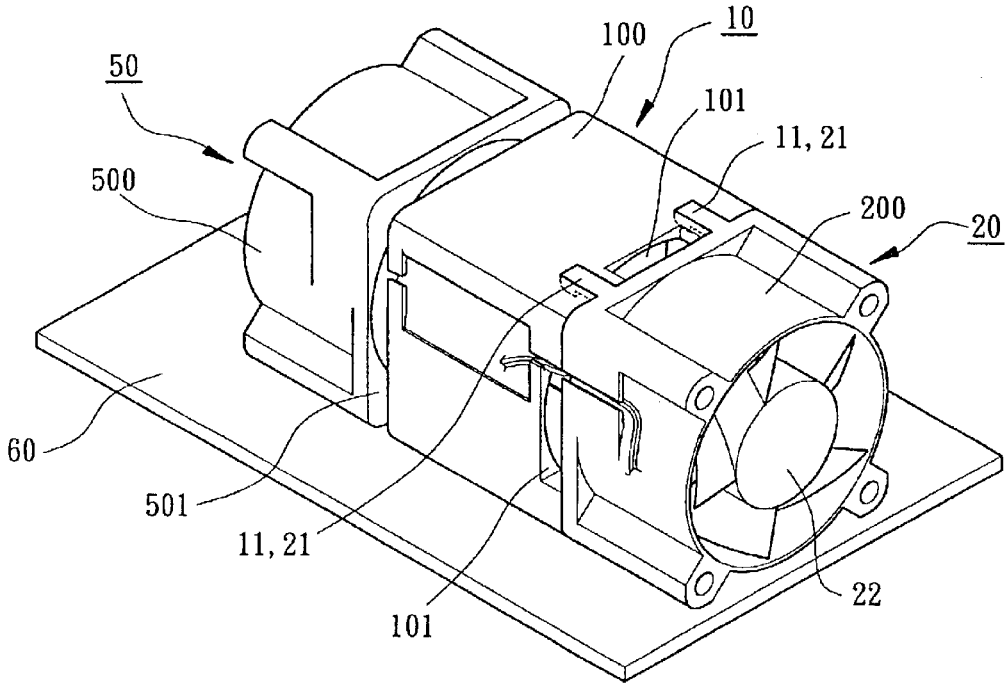
FIG. 11 is a perspective view of a fifth embodiment of the heat-dissipating module in accordance with the present invention.

FIG. 11 illustrates a fifth embodiment of the invention, wherein a third fan unit 50 is serially connected to the first fan unit 10 at the air inlet side of the first fan unit 10, with at least one side air inlet 501 being formed between two mutually facing end faces of the first fan unit 10 and the third fan unit 50. Alternatively, the third fan unit 50 can be serially connected to the second fan unit 20 at the air outlet side of the second fan unit 20. It is noted that the engaging grooves 11 and the engaging tabs 211 of FIG. 3, the engaging grooves 11 and the engaging tabs 21 of the type having a spacing portion 21 of FIG. 7, and the fasteners 40 and spacers 41 of FIG. 9 can be used in this embodiment. Further, the connecting means may include a board 60 on which the casings 100, 200, and 500 respectively of the first fan unit 10, the second fan unit 20, and the third fan unit 50 are fixed (e.g., by bonding, snapping, screwing, welding, etc.). The three fan units 10, 20, and 50 can be thus serially fixed on the board 60 and spaced apart from one another to directly form at least one side air inlet 101, 501 between two adjacent fan units 10 and 20; 10 and 50. Thus, the air input amount and the air output amount of the first fan unit 10 are increased by the side air inlets 501, and the air input amount and the air output amount of the second fan unit 20 are increased by the side air inlets 101. The basic designs of the first fan unit 10 and the second fan unit 20 are not affected.

The air input amount of the heat-dissipating module in accordance with the present invention is increased, and the overall heat-dissipating efficiency is improved. Further, the noise generated during operation of the heat-dissipating module is reduced.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A heat-dissipating module, comprising:

a first fan unit located on an air inlet side, said first fan unit including a casing;

a second fan unit located on an air outlet side, said second fan unit including a casing and a fan wheel received in the casing of said second fan unit; and connecting means for connecting said first fan unit and said second fan unit in a serial manner;

at least one side air inlet being defined between said casing of said first fan unit and said casing of said second fan unit for increasing an air inlet amount and an air outlet amount of said second fan unit, and wherein said at least one side air inlet is defined in one of two mutually facing end faces respectively of said casing of said first fan unit and said casing of said second fan unit.

2. The heat-dissipating module as claimed in claim 1, further including at least one stationary blade for guiding an air current and increasing wind pressure, said at least one stationary blade being provided on one of an air inlet side and an air outlet side of said first fan unit.

3. The heat-dissipating module as claimed in claim 1, wherein said connecting means include a plurality of engaging grooves defined in said first fan unit and a plurality of engaging tabs formed on said second fan unit.

4. The heat-dissipating module as claimed in claim 1, wherein said connecting means includes a board on which said casing of said first fan unit and said casing of said second fan unit are serially, securely fixed, said first fan unit and said second fan unit being spaced apart from each other to thereby define said at least one side air inlet.

5. The heat-dissipating module as claimed in claim 1, further including a further fan unit serially connected to one of an air inlet side of said first fan unit and an air outlet side of said second fan unit.

6. A heat-dissipating module comprising, a first fan unit located on an air inlet side, said first fan unit including a casing;

a second fan unit located on an air outlet side, said second fan unit including a casing and a fan wheel received in the casing of said second fan unit; and connecting means for connecting said first fan unit and said second fan unit in a serial manner;

at least one side air inlet being defined between said casing of said first fan unit and said casing of said second fan unit for increasing an air inlet amount and an air outlet amount of said second fan unit, wherein said at least one side air inlet is defined in each of two mutually facing end faces respectively of said casing of said first fan unit and said casing of said second fan unit.

7. A heat-dissipating module comprising, a first fan unit located on an air inlet side, said first fan unit including a casing;

a second fan unit located on an air outlet side, said second fan unit including a casing and a fan wheel received in the casing of said second fan unit; and connecting means for connecting said first fan unit and said second fan unit in a serial manner;

at least one side air inlet being defined between said casing of said first fan unit and said casing of said second fan unit for increasing an air inlet amount and an air outlet amount of said second fan unit, wherein said connecting means include a plurality of engaging grooves defined in said first fan unit and a plurality of engaging tabs formed on said second fan unit, and wherein each said engaging tab includes a spacing portion, allowing said first fan unit and said second fan unit to be spaced apart from each other, thereby forming said at least one said air inlet when said engaging tabs are engaged with said engaging grooves.

* * * * *